United States Patent [19]

Maezima

[11] 4,140,987

[45] Feb. 20, 1979

[54] CORE OF A CORE-TYPE TRANSFORMER

[75] Inventor: Masaaki Maezima, Hitachi, Japan

[73] Assignee: Hitachi, Ltd., Japan

[21] Appl. No.: 738,367

[22] Filed: Nov. 3, 1976

[30] Foreign Application Priority Data

Dec. 12, 1975 [JP] Japan ..... 50-148939

[51] Int. Cl.[2] ..... H01F 27/08; H01F 27/26

[52] U.S. Cl. ..... 336/60; 336/217

[58] Field of Search ..... 310/216, 217, 218; 336/216, 60, 217, 214, 215

[56] References Cited

U.S. PATENT DOCUMENTS

| | | | |
|---|---|---|---|
| 2,300,964 | 11/1942 | Putman | 336/217 |
| 2,628,273 | 2/1953 | Somerville | 336/217 |
| 3,069,643 | 12/1962 | Stein et al. | 336/217 |
| 3,157,850 | 11/1964 | Winter et al. | 336/217 |
| 3,200,358 | 8/1965 | Weydli | 336/217 |
| 3,201,733 | 8/1965 | Brown | 336/217 |
| 3,212,042 | 10/1965 | Twomey | 336/217 |
| 3,283,281 | 11/1966 | Stein et al. | 336/216 X |
| 3,559,136 | 1/1971 | Specht et al. | 336/217 |
| 3,569,886 | 3/1971 | Specht | 336/217 |

FOREIGN PATENT DOCUMENTS

| | | | |
|---|---|---|---|
| 215529 | 6/1961 | Austria | 336/217 |
| 879532 | 10/1961 | United Kingdom | 336/217 |

*Primary Examiner*—Thomas J. Kozma
*Attorney, Agent, or Firm*—Craig & Antonelli

[57] ABSTRACT

In a three-phase and three-leg core structure of a core-type transformer comprising three main legs of a substantially circular cross-sectional shape and a yoke of a non-circular cross-sectional shape for magnetically connecting the three main legs, each of the three main legs having a cross-sectional area substantially equal to the cross-sectional area of the yoke, wherein at least joints between the steel plate laminations of a center main leg and the adjoining steel plate laminations of the yoke are in a mitered oblique joint without requiring the shearing of the ends of the steel plate laminations, and the edges of the leg and yoke laminations at which edges the oblique miter joints are formed approach each other in length.

17 Claims, 32 Drawing Figures

CORE OF A CORE-TYPE TRANSFORMER

BACKGROUND OF THE INVENTION

This invention relates to three-phase and three-leg core structures of core-type transformers, and more particularly to a three-phase and three leg core structure of a core-type transformer having a yoke of a no-circular cross-sectional shape, wherein each of the main legs and the yoke are substantially equal to each other in cross-sectional area (including cases where the cross-sectional area of the yoke is greater by up to about 15% than the cross-sectional area of the main legs). In particular, the invention deals with the construction of a miter joint formed by each of steel plates constituting the main legs and each of steel plates constituting the yoke.

In cores of core-type transformers described above, a main leg 1 is stepped in cross-sectional shape, as shown in FIG. 1(*a*), in a manner such that the leg 1 may conform to the shape of the inner surface of a circular coil to maximize the internal space of the circular coil occupied by the leg. Meanwhile the yoke 2 is available in a variety of cross-sectional shapes including a circular shape and non-circular shapes, such as square, semi-elliptic and elliptic shapes, as shown in FIG. 1(*b*) to FIG. 1(*d*). While the yoke of a circular cross-sectional shape conforms to the shape of the inner surface of the circular coil as does the leg 1, the yokes of non-circular cross-sectional shapes have been fabricated for the purpose of reducing the height of the yoke to overcome transportation difficulty and other restrictions.

It is publicly known that in a three-phase and three-leg core of a core-type transformer wherein the yoke 2 has a circular cross-sectional shape as does the main leg 1, steel plates 1*a* to 1*c* (See FIG. 2) constituting the main leg 1 have a width $l_1$ which varies depending on the position of the steel plates 1*a* to 1*c* in a stack of steel plates forming a core. As the width $l_1$ of the steel plates 1*a* to 1*c* varies, the width $l_2$ of steel plates 2*a* to 2*d* constituting the yoke 2 also varies, so that the steel plates 1*a* to 1*c* of the main leg 1 and the steel plates 2*a* to 2*d* of the yoke 2 have the same width at all times. As shown in FIG. 2, the angle $\theta$ formed by a joint 4 between the main leg 1 and the yoke 2 and the axis 3 of the main leg 1 (hereinafter referred to as the joint angle) is 45° at any position in the stack of steel plates forming the core as is customary with anisotropic silicon steel plates.

However, if the steel plates are joined in the manner shown in FIG. 2 in a three-phase and three-leg core of a core-type transformer wherein the yoke is non-circular in cross-sectional shape, the following problems will arise.

Let us proceed with the case in which the yoke 2 is square in cross-sectional shape. In this case, as shown in FIG. 3, the width $l_2$ of the steel plates constituting the yoke 2 and the widths $l_{11}$ to $l_{18}$ of the steel plates constituting the main leg 1 are substantially related to one another as follows:

$$l_{11}<l_{12}<l_{13}<l_{14}<l_2<l_{15}<l_{16}<l_{17}<l_{18}$$

The result of this is that, if one attempts at fabricating a three-phase and three-leg core having a yoke of a non-circular cross-sectional shape by joining the steel plates at the customary joint angle of 45°, the core will be constructed as shown in FIG. 4(*a*) when the width $l_2$ of the steel plates constituting the yoke 2 is smaller than the width $l_1$ of the steel plates constituting the main leg 1 or $l_2<l_1$ and will be as shown in FIG. 4(*b*) when $l_2>l_1$.

Because of this, the steel plates constituting the yoke 2 and the main leg 1 include a large number of steel plates which require end cutting at one or both ends as shown in FIG. 5(*a*) and FIG. 5(*b*). This has disadvantages in that a cutting operation is troublesome and in addition the yield of the products is low.

Also, an anisotropic silicon steel plate has a magnetic permeability which, as shown in FIG. 6, becomes markedly low in a portion of the steel plate which deviates from the direction in which rolling has been performed. In actual practice, a zone of the steel plate which is more than 50° away from the rolling direction has a magnetic permeability which is below 1/100 the magnetic permeability of the zone of the steel plate disposed in the rolling direction. Calculation of a magnetic field conducted recently by taking into consideration the anisotropicity of magnetic permeability clearly shows that the magnetic flux in the interior of the core using anisotropic silicon steel plates flows in the rolling direction in which there is a high magnetic permeability. Thus, it will be seen that when a core is constructed as shown in FIG. 4(*a*) the flow of the magnetic flux will be non-uniform at the joints of the steel plates as shown in FIG. 7(*a*) and FIG. 7(*b*).

More specifically, at a joint formed by each of the steel plates 1*a* constituting the main leg 1 (hereinafter referred to as the main leg steel plate) and each of the steel plates 2*a* constituting the yoke 2 (hereinafter referred to as the yoke steel plate), the magnetic flux is concentrated in an inner corner portion of the main leg steel plate 1*a*, with almost no magnetic flux flowing in an outer marginal portion thereof. Thus the main leg steel plates of a large width are not utilized effectively. Also, concentration of the magnetic flux is noted at joints formed by the yoke steel plates 2*a* and 2*b* and the main leg steel plate 1*b*, as shown in FIG. 7. This has disadvantages in that a local loss occurs and core loss is increased.

On the other hand, proposals have been made to change the joint angle in a core structure. One example of such proposals involves the use of a single-phase and two-leg core structure shown in FIG. 9. However, in this core structure, the joint formed by the main leg steel plate 1*a* and the yoke steel plate 2*a* is in the form of a straight line ST starting at an inner corner point S and extending to an outer corner point T at an angle $\theta_1$, and the joint of the adjacent steel plate layer is in the form of a straight line SU starting at the inner corner point S and extending to a point U at an angle of $\theta_2$. Stated differently, the width of the overlapping portions of the adjacent steel plate layers increases in going outwardly from the inner corner point.

Because of this arrangement, the steel plates have a reduced lap dimension (the length of the overlapping portions of the adjacent steel plate layers) on the inner side, and the steel plates will be joined in a butt joint (a joint wherein the lines of the joints of the adjacent steel plate layers are disposed in substantially the same vertical plane with respect to the layers) on a considerable scale, if there is error in the operations of stacking and inserting the steel plates to fabricate a core. This has disadvantages in that core loss and the value of an exciting current are markedly increased depending on how the operations are performed and the cores produced are not stable in quality. Conversely, if the lap dimension of the adjacent steel plate layers is increased, there will be the disadvantages of the amount of end cut steel material increasing and of the yield of the steel plates reducing.

Moreover, if this joint structure is applied to a three-phase and three-leg core structure, the butt joint portion on the inner side will cause the magnetic flux to be concentrated in the outer side of the core because of high magnetic reluctance on the inner side of the core, thereby increasing core loss.

SUMMARY OF THE INVENTION

Accordingly, an object of this invention is to provide a three-phase and three-leg core structure of a core type transformer which eliminates the aforementioned disadvantages of transformers having yokes of a non-circular cross-sectional shape of the prior art, wherein the efficiency of the cutting operation and the yield of the products can be increased, distribution of the magnetic flux in the transformer core can be rendered uniform, and core loss can be reduced.

Another object of the invention is to provide, in a three-phase and three-leg core structure of a core-type transformer having main legs of a substantially circular cross-sectional shape and a yoke of a non-circular cross-sectional shape, the main legs and the yoke being substantially the same in cross-sectional area, a core structure of the type described wherein each of steel plates constituting at least the central leg and each of steel plates constituting the yoke are joined obliquely without requiring end cutting and the sides of the steel plates at which a joint is formed are substantially of the same length.

Still another object of the invention is to provide, in a three-phase and three-leg core structure of a core-type transformer of the type described, a core structure wherein a cutout is formed in the side of a steel plate of a larger width at least with respect to a miter joint between the steel plate of the center leg and the steel plate of the yoke after comparing the width of the steel plate of the center leg with the width of the steel plate of the yoke.

Additional and other objects and advantages of the invention will become apparent from the description of preferred embodiments set forth hereinafter when considered in conjunction with the accompanying drawings.

DESCRIPTION OF THE PREFERRED EMBODIMENTS

Figure 8A:
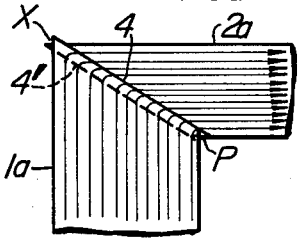
FIG. 8(*a*) and FIG. 8(*b*) are views showing distribution of the magnetic flux, in explanation of the basic concept on which the present invention is based.
Figure 8B:
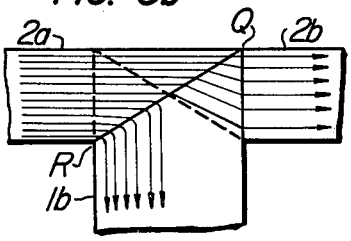
Figure 9:
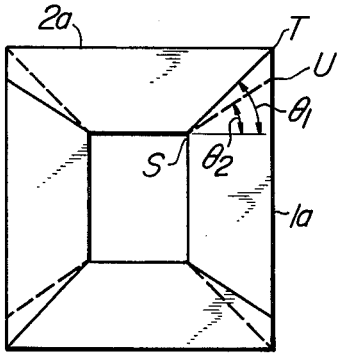
FIG. 9 PRIOR ART
FIG. 9 is a schematic view of a single-phase and two-leg core structure of the prior art.
Figure 10:
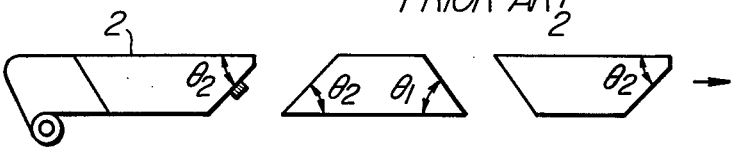
FIG. 10 PRIOR ART
FIG. 10 is a view in explanation of the method for cutting steel plates constituting the single-phase and two-leg core structure shown in FIG. 9.

The principle of the present invention will first be described with reference to FIG. 8(*a*) and FIG. 8(*b*). According to the invention, when the main leg steel plates 1*a*, 1*b* differ from the yoke steel plates 2*a*, 2*b* in width, the main leg steel plate 1*a* is joined to the main yoke steel plate 2*a* in a manner such that a miter joint 4 substantially extends from an outer corner point X to an inner corner point P as shown in FIG. 8(*a*) without sticking to the conventional concept of the joint angle of 45° for oriented silicon steel plates. The adjacent steel plate layer has a joint 4' which is parallel to but displaced horizontally from the joint 4 by 10 to 50 mm. In joining the central main leg steel plate 1*b* to the yoke steel plates 2*a*, 2*b*, a miter joint is formed in a manner such that a point Q at which an upper surface of the yoke and the vertex of the main leg steel plate 1*b* meet each other is connected to an inner corner point R as shown in FIG. 8(*b*). In forming a joint in the adjacent steel plate layer, the arrangement is reversed from what is described above.

Figure 5A:
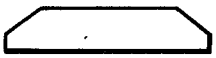
FIG. 5a PRIOR ART
FIG. 5(*a*) and FIG. 5(*b*) are plan views of steel plates constituting the conventional core structures shown in FIG. 4.
Figure 5B:
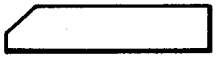
FIG. 5b PRIOR ART
Figure 6:
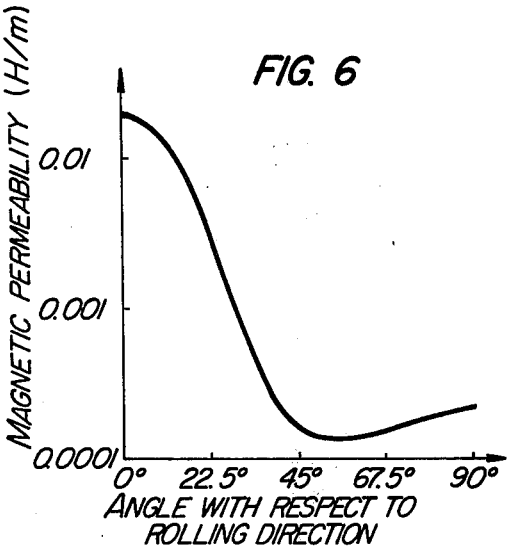
FIG. 6 is a graph showing the relation between the angle and magnetic permeability of an oriented silicon steel plate.
Figure 7A:
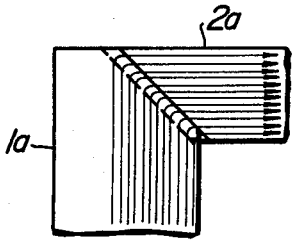
FIG. 7a PRIOR ART
FIG. 7(*a*) and FIG. 7(*b*) are views showing distribution of the magnetic flux in a three-phase and three-leg core structure of the prior art.
Figure 7B:
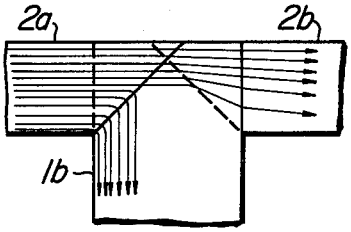
FIG. 7b PRIOR ART

In the three-phase and three-leg core structure constructed as aforesaid, distribution of the magnetic flux can be made uniform as compared with distribution of the magnetic flux in the three-phase and three-leg core structure wherein the main legs and the yoke are joined at the joint angle of 45° as shown in FIG. 7. Moreover, the use of the end cut steel plates shown in FIG. 5(*a*) and FIG. 5(*b*) can be eliminated.

Figure 11:
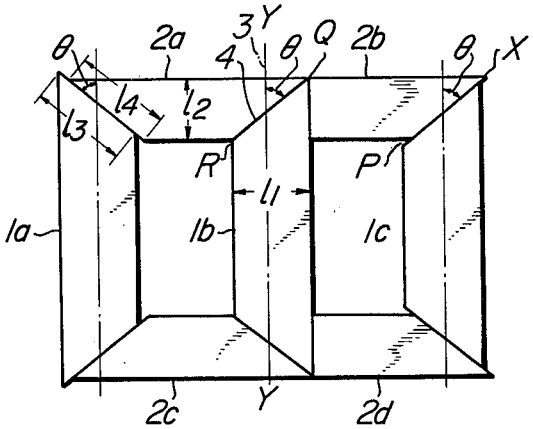
FIG. 11 is a schematic view of the three-phase and three-leg core structure comprising one embodiment of this invention.

FIG. 11 shows one embodiment based on the principle of this invention shown and described with reference to FIG. 8 which eliminates the defects of the prior art. FIG. 11 shows one unit layer of a stack of steel plate laminations constituting the core structure according to the invention. As shown, three main leg steel plates 1*a*, 1*b* and 1*c* of a trapezoidal form prepared by obliquely cutting steel plates at the ends thereof are arranged in spaced parallel relationship, and the yoke steel plates 2*a*, 2*b*, 2*c* and 2*d* are joined to upper and lower ends of the main leg steel plates 1*a*, 1*b* and 1*c*. The steel plates for the main legs and the yoke are joined such that the length $l_3$ of sides of the main leg steel plates 1*a*, 1*b* and 1*c* joined to sides of the yoke steel plates 2*a*, 2*b*, 2*c* and 2*d* approaches the length $l_4$ of the sides of the yoke steel plates 2*a*, 2*b*, 2*c* and 2*d* joined to the sides of the main leg steel plates 1*a*, 1*b* and 1*c*. In a miter joint formed by one outer main leg and the yoke, the main leg is displaced horizontally outwardly along the joint by 10 to 50 mm from the point X at which outer ends of the sides of the main leg and the yoke to be joined meet each other, while in a joint formed by the other outer main leg and the yoke, the main leg is displaced horizontally inwardly along the joint by 10 to 50 mm from the point X at which outer ends of the sides of the main leg and the yoke to be joined meet each other. The adjacent steel plate layer lamination is formed such that the aforementioned arrangement of the steel plates for the main legs and the yoke are reversed with respect to the Y—Y axis.

More specifically, the miter joints 4 formed by the main leg steel plates 1*a* and 1*c* and the yoke steel plates 2*a* and 2*b* respectively are reversed to each other with respect to the straight line XP connecting the inner corner point P to the outer corner point X, and the miter joints 4 formed by the central main leg steel plate 1 and the yoke steel plates 2*a* and 2*b* connect the inner corner point R to the point Q at which the upper surface of the yoke meets the vertex of the main leg steel plate 1*b*.

Figure 1A:
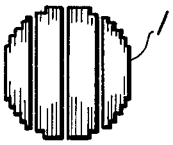
FIG. 1(*a*) to FIG. 1(*d*) are sectional views of the main leg and the yoke of a three-phase and three-leg core structure.
Figure 1B:
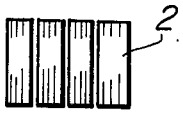
Figure 1C:
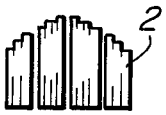
Figure 1D:
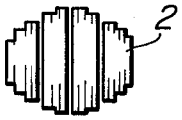
Figure 2:
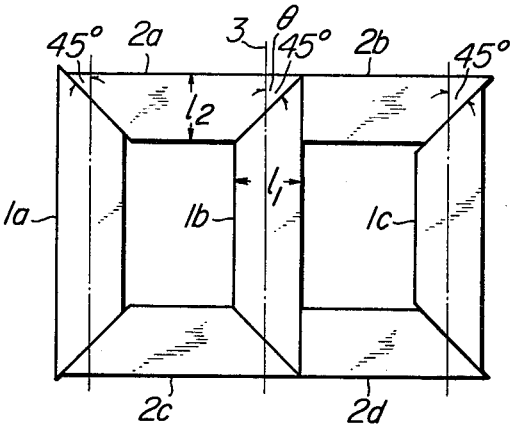
FIG. 2 PRIOR ART
FIG. 2 is a schematic view of a three-phase and three-leg core structure of the prior art having a yoke of a circular cross-sectional shape.
Figure 3:
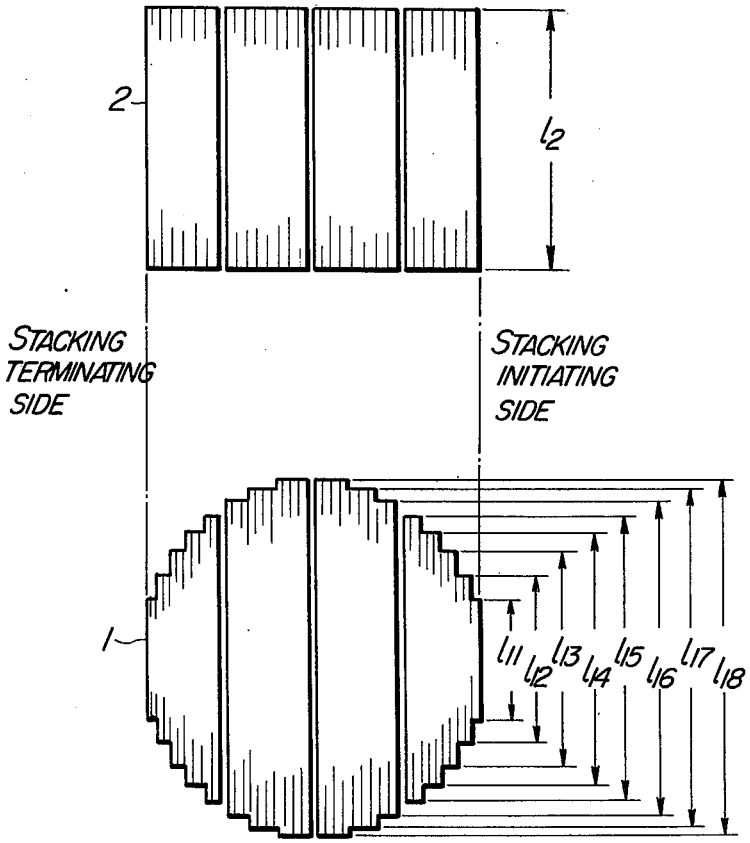
FIG. 3 is a view in explanation of the comparison of the cross-sectional shape of the main leg with the cross-sectional shape of the yoke in the transformer according to the present invention.
Figure 4A:
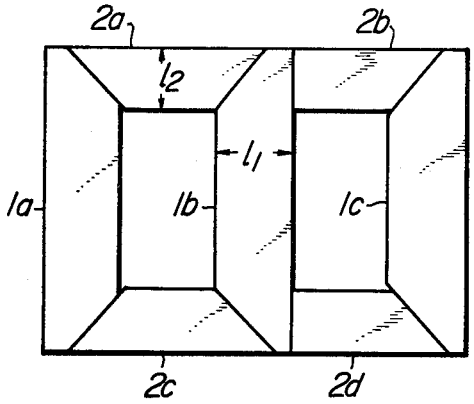
FIG. 4a PRIOR ART
FIG. 4(*a*) and FIG. 4(*b*) are schematic views of conventional three-phase and three-leg core structures each having a yoke of a non-circular cross-sectional shape.
Figure 4B:
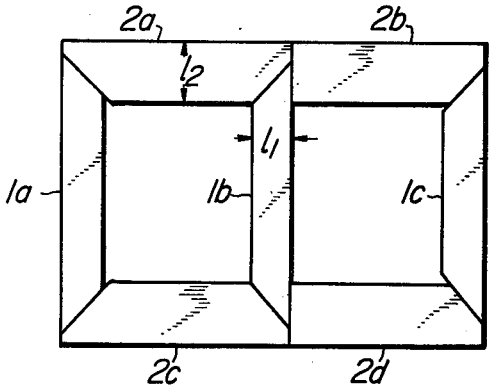
FIG. 4b PRIOR ART

This invention is directed to the core structure of a core-type transformer having a yoke of a non-circular cross-sectional shape. In this type of core structure, the width $l_1$ of the steel plates constituting the main leg 1 varies, as shown in FIG. 3, depending on the position in which the steel plates are disposed in the stack of steel plate layers. Thus, the joint angle $\theta$ of the unit stack of steel plates for the legs and the yoke shown in FIG. 11 is smaller than 45° at the layers formed in the initial stages of stacking because of $l_2>l_1$. However, the joint angle $\theta$ increases in going from the lower to the upper layers or as the value of $l_1$ increases until the joint angle $\theta$ becomes larger than 45° when $l_2<l_1$. The core structure according to the invention is formed by combining a number of unit layers of steel plates differing from one another in joint angle $\theta$.

Thus, in the embodiment shown and described above, the steel plates constituting the core structure include no steel plate laminations which have been subjected to end cutting (i.e. cutting the ends of the lamination). This results in an increase in the efficiency with which a cutting operation is performed and in the yield of the products. Moreover, the core structure fabricated in this way has a uniform distribution of the magnetic flux and improved magnetic characteristics.

Meanwhile, the core structure provided by the invention has a yoke which is non-circular in cross-sectional shape as aforementioned. If the yoke is rectangular in cross-sectional shape, for example, the width $l_1$ of the steel plates constituting the main leg 1 varies from $l_{11}$ to $l_{18}$ depending on the position in which each layer of the steel plates for the main leg is disposed in the stock while the width $l_2$ of the steel plates constituting the yoke 2 is constant, as shown in FIG. 3. Because of this, in the embodiment shown in FIG. 11, the joint angles $\theta$ formed by the joint 4 connecting the points Q and R where the central main leg steel plate 1*b* meets the yoke steel plates 2*a* and 2*b* the center axis 3 of the main leg steel plate 1*b* are as many in number as the widths or layers of the steel plates constituting the main leg 1. Moreover, the relation between $l_1$ and $l_2$ generally varied depending on the core circle (a circle surrounding a main leg core), so that the number of the joint angles $\theta 0$ is further increased.

Thus, in cutting steel plates for the yoke and the main leg for different layers from a steel strip, it is necessary to cut the steel plates such that the angle of cut differs depending on the joint angle of the steel plates. Since there are a lot of different joint angles, difficulty is experienced in continuously performing a cutting operation, thereby lowering the efficiency with which cutting is performed.

By incorporating the following features in the embodiment shown in FIG. 11, it is possible to greatly reduce the number of different cut angles and to shorten the period of time required for setting and adjusting the cutting angles in performing a steel plate cutting operation, thereby greatly increasing the efficiency with which a cutting operation is performed.

Figure 12A:
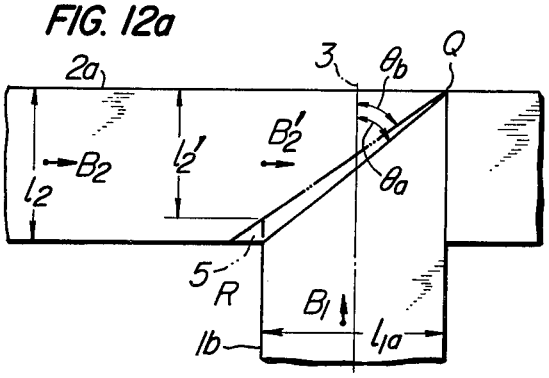
FIG. 12(*a*) to FIG. 12(*c*) are view in explanation of the embodiments in which cutouts are formed.
Figure 12B:
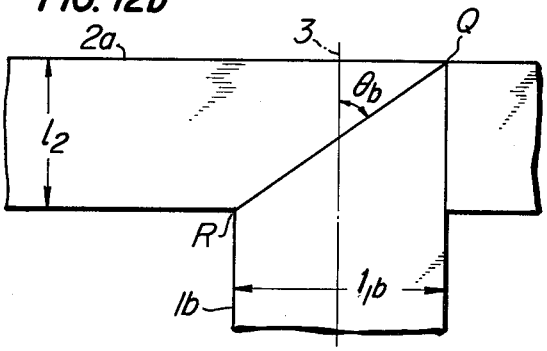
Figure 12C:
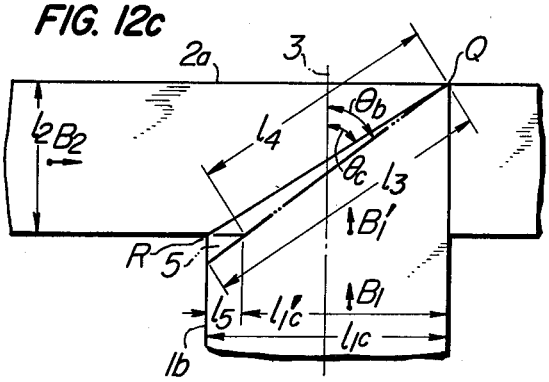

As can be clearly seen in FIG. 3, the width $l_2$ of the steel plates constituting the yoke is greater than the width $l_1$ of the steel plates constituting the main leg or $l_2>l_1$ in layers of a core where the width $l_1$ is small, and $l_2<l_1$ in layers where the width $l_1$ is great. FIG. 12(*a*) to FIG. 12(*c*) show how the main leg steel plate 1*b* can be joined to the yoke steel 2*a* when the width $l_2$ of the yoke steel plate is smaller than the width $l_1$ of the main leg steel. In the figures, there are shown three main leg steel plates 1*b* of three different widths in which $l_{1a}<l_{1b}<l_{1c}$, and the joint angles are $\theta_1$, $\theta_2$ and $\theta_3$ respectively when the sides of the main leg steel plate 1*b* and the yoke steel plate 2*a* joined to each other have the same length. In each of the examples shown, the sides of the main leg steel plate 1*b* and the yoke steel plate 2*a* are joined in a manner such that the joint extends between the points Q and R at which the two steel plates meet. Magnetic flux density is $B_1<B_2$. For the purpose of reducing the number of different cut angles, the main leg steel plates and the yoke steel plates have been obtained by cutting steel plates at a predetermined cut angle $\theta_b$, with the steel plates of different types being made to coincide only at the point Q. The main leg steel plates and the yoke steel plates cut in this way have been joined to each other by letting the steel plates coincide at the point Q. Miter joints formed in this way are shown in broken lines.

In FIG. 12(*a*), there is shown an example in which the side of the yoke steel plate 2*a* and the side of the main leg steel plate 1*b* which have been joined to each other differ from each other in length because the steel plates have been cut at the cut angle $\theta_b$. Thus, if the yoke steel plate 2*a* and the main leg steel plate 1*b* which have been cut at the cut angle $\theta_b$ are joined to each other by letting them coincide at the point Q, a cutout 5 is formed in the yoke steel plate 2*a*. Accordingly, the yoke steel plate 2*a* has a width $l_2'$, which is smaller than $l_2$, at a point in the yoke steel plate 2*a* at which the main leg steel plate 1*b* of the width $l_{1a}$ intersects the joint. In this portion of the yoke steel plate 2*a*, there is a magnetic flux density $B_2'$ and the magnetic flux is concentrated in this yoke portion because $B_2'>B_2>B_1$. This causes a loss and local overheating to occur. It will thus be appreciated that when $l_2<l_1$, it is not desirable to cut and join the steel plates in a manner such that a cutout is formed in the yoke steel plate 2*a* which has a smaller width than the main leg steel plate 1*b*.

On the other hand, in the case shown in FIG. 12(*c*) in which the steel plates are cut at the cut angle $\theta_b$ to reduce the number of different cut angles, instead of using the joint angle $\theta_c$ to render the lengths of the sides of the yoke steel plate 2*a* and the main leg steel plate 1*b* equal to each other, the cutout 5 is formed in the main leg steel plate 1*b* of a larger width. The main leg steel plate having the cutout 5 has a magnetic flux density $B_1'$ which is smaller than the magnetic flux density $B_2$ in the yoke steel plate 2a because $B_2 > B_1' > B_1$. Thus there is no concentration of the magnetic flux in the main leg steel plate 1b. By selecting a suitable value for the width $l_5$ of the cutout 5 [about 10% of the width $l_{1c}$ of the main leg steel plate of FIG. 12(*c*)], it is possible to provide a magnetic flux distribution which is substantially similar to the magnetic flux distribution obtained in the case of steel plates cut at the cut angle $\theta_c$. Thus it is possible to join the main leg steel plate 1b to the yoke steel plate 2a in the example shown in FIG. 12(*c*) at the same angle as the example shown in FIG. 12(*b*), without bringing about a change in characteristics, although the ratio of the width $l_2$ of the yoke steel plate to the width $l_1$ of the main leg steel plate 1b in the example of FIG. 12(*c*) differs slightly from the corresponding ratio in the example of FIG. 12(*b*).

Accordingly, the following features are incorporated in the basic joint structure of the embodiment shown in FIG. 11. In order to reduce the number of different joint angles, the steel plates are cut and joined to one another in a manner such that, when the comparison of the width $l_2$ of the yoke steel plates with the width $l_1$ of the main leg steel plates shows that $l_2 > l_1$, at least with respect to the central main leg, cutout is formed in the yoke steel plate and the width $l_2'$ of the yoke steel plates minus the width of the cutouts is greater than $l_1$, and that, in cases where $l_2 < l_1$, the cutout is formed in the main leg steel plate or at least in the central main leg steel plate and the width $l_1'$ of the main leg steel plates minus the width of the cutouts is greater than $l_2$. By virtue of these features, it is possible to provide a core structure wherein the main leg steel plates and the yoke steel plates can be joined to one another at the same joint angle of several layers in a stack of steel plate layers, and to reduce the number of different cut angles to 3 or 4 at most. This greatly increases the efficiency with which a cutting operation is performed. Moreover, the core structure in which these features are incorporated has high magnetic characteristics, because portions of the core having cutouts have a lower magnetic density than portions thereof having no cutouts and concentration of the magnetic flux can be avoided.

Figure 13A:
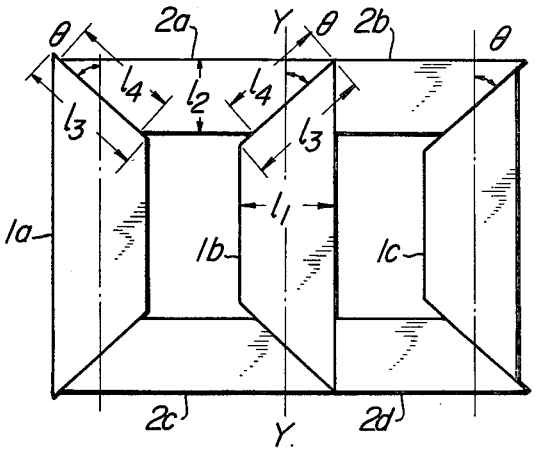
FIG. 13(*a*) and FIG. 13(*b*) to FIG. 19 are schematic views of the three-phase and three-leg core structures comprising other embodiments of the invention.
Figure 13B:
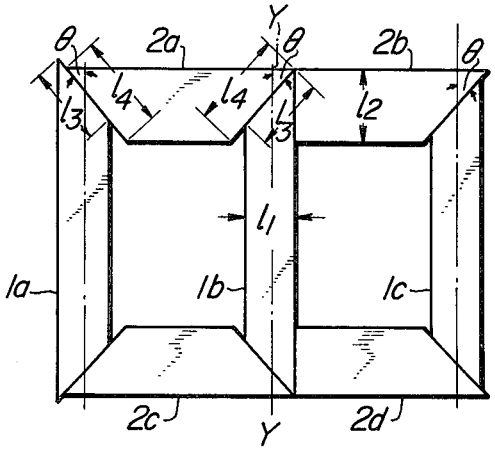

FIG. 13(*a*) and FIG. 13(*b*) show further embodiments in which the aforesaid features are incorporated. In these embodiments, the main leg steel plates 1a, 1b and 1c are joined to the yoke steel plates 2a, 2b, 2c and 2d at a suitable joint angle in a manner such that the length $l_3$ of the sides of the main leg steel plates approaches the length $l_4$ of the sides of the yoke steel plates when these steel plates are joined at these sides. This arrangement is reversed in the adjacent steel plate layer with respect to the Y—Y axis. In the embodiment shown in FIG. 13(*a*) wherein $l_2 < l_1$, a joint angle is selected such that the cutouts 5 are formed in the main leg steel plates 1a to 1c of a larger width than the yoke steel plates. In the embodiment shown in FIG. 13(*b*) wherein $l_2 > l_1$, a different joint angle is selected such that the cutouts 5 are formed in the yoke steel plates 2a to 2d of a larger width than the main leg steel plates. Several layers of the main leg steel plates and the yoke steel plates joined to one another at different joint angles are stacked to provide a core structure.

In the case of cores of a large size, it is necessary to rigidly fasten the main legs 1 and the yoke 2 together into a unitary structure, and to provide oil ducts *g* in the layers of steel plates constituting the yoke 2 in order to cool the core. Cores of the large size incorporating these features therein can be provided by this invention as shown in FIG. 14.

Figure 14:
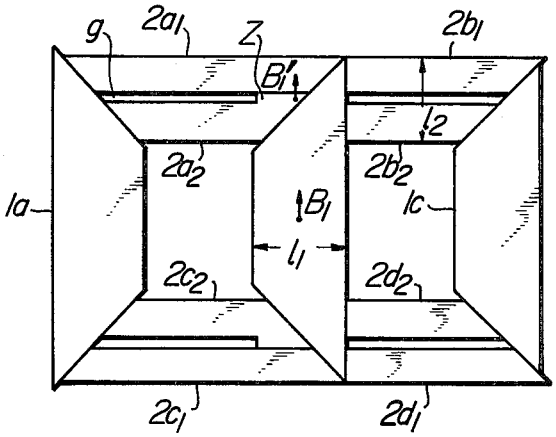

In the embodiment shown in FIG. 14, the oil ducts *g* are each formed substantially in the central portion of each section of the yoke. In a core structure wherein the width $l_2$ of the yoke is smaller than the width $l_1$ of the main legs, the cutouts 5 are formed in the main leg steel plates 1a, 1b and 1c, and a projection Z is formed in a yoke steel plate portion $2a_2$ to improve the magnetic connection of the yoke steel plate portion $2a_2$ to a yoke steel plate portion $2a_1$ as shown in FIG. 14. The projection Z has a left end portion which substantially coincides with the left side of the central main leg 1b and a right end portion which coincides with the joint between the steel plates 1b and 2a. A magnetic flux passing through a zone defined by a horizontal plane including the projection Z (a zone in yoke steel plate portions $2a_1$ and $2b_1$ surrounded by the oil duct *g*) is about ½ the magnetic flux passing through the main leg steel plate 1b. Therefore, the projection Z has a magnetic flux density $B_1s'$, is about one half the magnetic flux density in the main legs 1. Moreover, since the ducts *g* are about 10 to 20 mm in width, these portions of the core have a magnetic reluctance which is much smaller than the magnetic reluctance in the core as a whole. Thus, unless the zone of the core defined by the horizontal plane including the projection is saturated (saturating magnetic flux density, 20300 Gauss), there will be no change in the magnetic connection between the yoke steel plate portions $2a_1$ and $2a_2$. Accordingly, if the working magnetic flux density is 16000 Gauss, it will be seen that the cross-sectional area of the main leg at the position where the projection Z is located will only have to be about 40% from the following formula:

$$16000/2 \times 1/0.40 = 20000 \text{ (Gauss)}$$

In the present invention, the length $l_3$ of the sides of the main leg steel plates joined to the sides of the yoke steel plates approaches the length $l_4$ of the sides of the yoke joined to the sides of the main leg steel plates. The portion of the central main leg steel plate 1b in which the oil duct *g* is positioned has a width $l_6$ [See FIG. 15(*a*)] which is sufficiently large to be 40% of the width $l_1$. Thus, it is possible to eliminate the projection Z. The result of this is that the cutting operation can be performed with increased efficiency and the yield of the products can be increased.

Figure 15A:
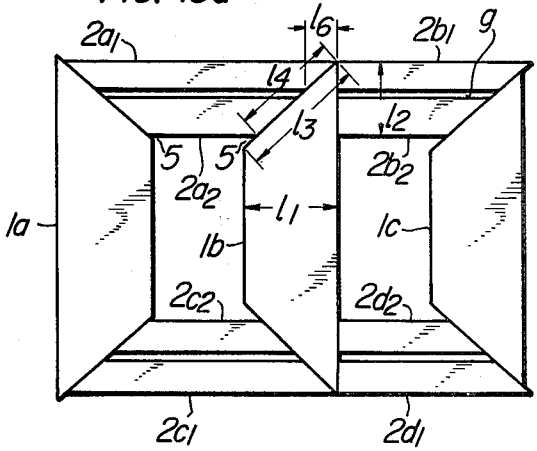
Figure 15B:
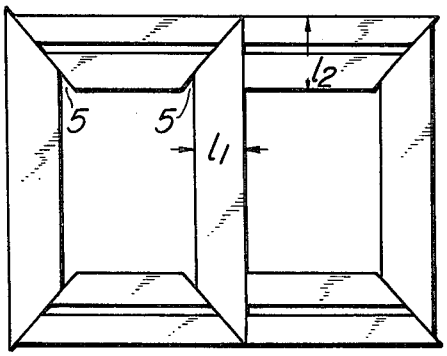

FIG. 15(*a*) and FIG. 15(*b*) illustrate embodiments of this type which are of the same construction as the embodiments shown in FIG. 13 except for the facts that the oil ducts *g* are formed in the yoke 2 and that the width $l_6$ of the portion of the central main leg steel plate 1b positioned on the oil duct is over 40% of the width $l_1$ of the whole of the steel plate 1b.

Figure 16A:
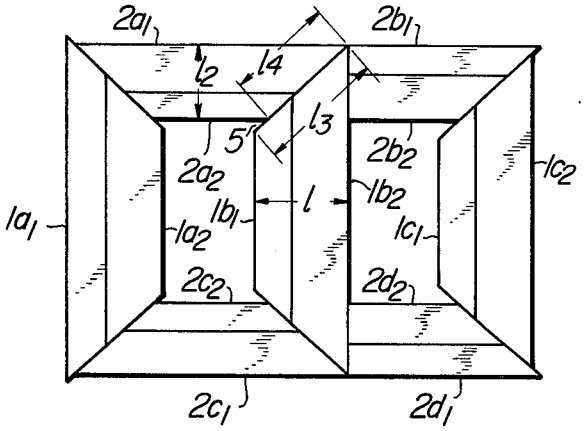
Figure 16B:
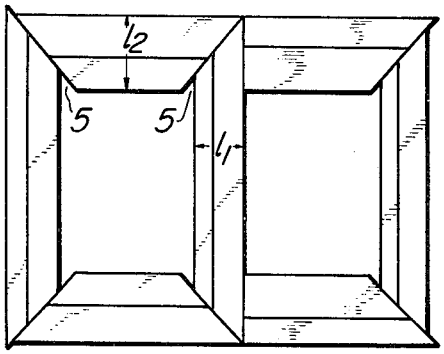

Other embodiments of the invention will be described with reference to FIG. 16 to FIG. 19. FIG. 16(*a*) and FIG. 16(*b*) show cores of a large size in which the main legs 1 and the yoke 2 are each formed in two pieces, because silicon steel plates of a width sufficiently large to provide a core of a required cross-sectional area are not commercially obtainable. The embodiments are substantially similar in construction to the embodiments shown in FIG. 13 except for the fact that the main legs 1 and the yoke 2 are provided by bringing steel plates of different widths into abutting engagement. It is to be understood that if necessary the main legs 1 and the yoke 2 may be formed in three or more pieces.

Figure 17A:
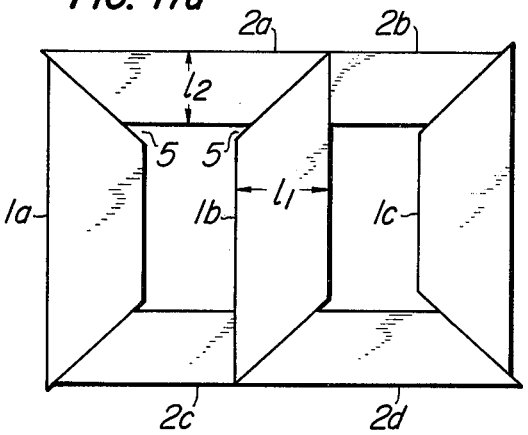
Figure 17B:
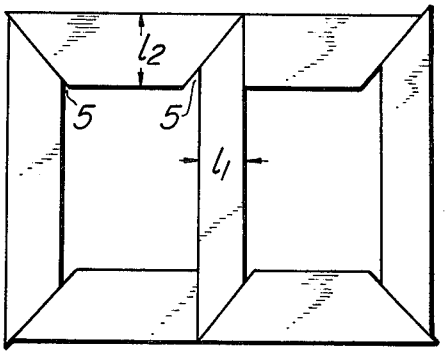

FIG. 17(*a*) and FIG. 17(*b*) illustrate embodiments wherein the central main leg steel plate 1*b* alone is in the form of a parallelogram and the other main leg steel plates 1*a* and 1*c* are trapezoidal in form. In other respects, the embodiments are similar to the embodiments shown in FIG. 13.

Figure 18:
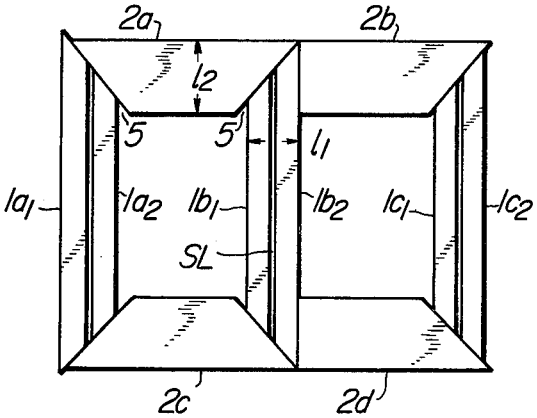

FIG. 18 shows an embodiment wherein a slit SL is formed on the surface layers alone of each main leg 1, in order to prevent local overheating due to the leakage flux. The slits SL may, for example, be about 2 mm in width and about 20 mm in depth.

It is to be understood that the cores of a large size formed with the oil ducts *g* in the yoke as shown in FIG. 15 may be fabricated by joining the steel plates in the same manner as described with reference to FIG. 16 to FIG. 18.

Figure 19:
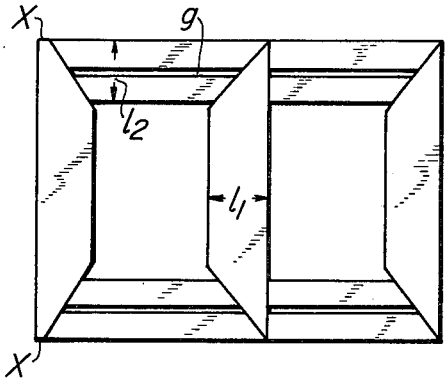

FIG. 19 shows a further embodiment wherein the front end portions of steel plates constituting one outer main leg which front end portions extend outwardly of the upper face and the lower face of steel plates constituting the yoke are cut off horizontally and removed at the points X where the outer main leg steel plates are joined to the yoke steel plates, in order to prevent concentration of an electric field in the front end portions of the outer main leg steel plates. The embodiment shown in FIG. 19 is preferably used in a joining position which corresponds to the position in which leads are disposed.

From the foregoing description, it will be appreciated that according to the invention there is provided a core structure wherein the steel plates constituting the main legs and the steel plates constituting the yoke are obliquely joined to one another at least with respect to the central main leg, and wherein sides of the steel plates joined to one another have substantially the same length. This enables the major portion of the steel plates constituting the main legs and the yoke to be produced by oblique cutting and square cutting. Thus, the invention makes it possible to greatly increase the efficiency with which a cutting operation is performed, to increase the yield of the products, to render uniform the magnetic flux distribution, and to reduce core loss.

I claim:

1. A three-phase and three-leg core structure of a core-type transformer comprising:

two outer main legs and one center main leg, said main legs being substantially circular in cross-sectional shape; and a yoke of a non-circular cross-sectional shape for magnetically connecting said main legs, said yoke having a cross-sectional area which is substantially equa equal the cross-sectional area of each of said main legs, said main legs and said yoke being formed of a plurality of stacked steel plate laminations, corresponding laminations in said main legs and yoke being magnetically connected to form respective layers of said core structure, and wherein the layers of said core structure each include a steel plate lamination of the center main leg which is magnetically connected to a steel plate lamination of said yoke by at least one oblique miter joint without requiring the cutting-off of terminal ends of said laminations, and wherein at least some of the joint angles which the oblique miter joints make with respect to the longitudinal axis of the center leg while magnetically connecting the steel plate laminations of the center leg to the corresponding steel plate laminations of the yoke are different angles, those joint angles of the oblique miter joints less than 45° occurring only where the width of the yoke steel plate is larger than that of the corresponding center leg steel plate, and those joint angles of the oblique miter joints greater than 45° occurring only where the width of the yoke steel plate is smaller than that of the corresponding center leg steel plate.

2. A three-phase and three-leg core structure as claimed in claim 1, wherein each of the steel plate laminations stacked in layers to constitute the main legs and each of the steel plate laminations stacked in layers to constitute the yoke comprise steel plates of different widths arranged in abutting relationship.

3. A three-phase and three-leg core structure as claimed in claim 1, wherein oil ducts are formed in the yoke and extend in the longitudinal direction thereof, projections are formed in oil duct portions of the yoke obliquely miter joined to the central main leg to improve magnetic connection, and edges of the projections disposed opposite to the oblique joints substantially coincide with a lateral side of the central main leg.

4. A three-phase and three-leg core structure as claimed in claim 1, wherein oil ducts are formed in the yoke and extend in the longitudinal direction thereof, each of said oil ducts extending along the entire length of each segment of the yoke.

5. A three-phase and three-leg core structure as claimed in claim 1, wherein the steel plate laminations stacked in layers to constitute the central main leg are trapezoidal in form.

6. A three-phase and three-leg core structure as claimed in claim 1, wherein the steel plates stacked in layers to constitute the central main leg are in the form of a parallelogram.

7. A three-phase and three-leg core structure of a core-type transformer as claimed in claim 1 wherein:

one of said two outer main legs is joined to said yoke such that terminal ends of said one outer main leg are cut off so that they are flush with the yoke; and oil ducts are formed in said yoke and extend in the longitudinal direction thereof, each of said oil ducts being disposed substantially in the central portion of the lamination of the yoke.

8. A three-phase and three-leg core structure as claimed in claim 1, wherein the edges of the leg and yoke laminations on which edges the respective oblique miter joints are formed approach each other in length such that the magnetic flux distribution of the respective miter joints is substantially similar to the magnetic flux distribution obtained when the edges are the same length.

9. A three-phase and three-leg core structure as claimed in claim 8, wherein each of the steel plate laminations stacked in layers to constitute the main legs and each of the steel plate laminations stacked in layers to constitute the yoke comprise steel plates of different widths arranged in abutting relationship.

10. A three-phase and three-leg core structure as claimed in claim 8, wherein oil ducts are formed in the yoke and extend in the longitudinal direction thereof, projections are formed in oil duct portions of the yoke obliquely miter joined to the central main leg to improve magnetic connection, and edges of the projections disposed opposite to the oblique joints substantially coincide with a lateral side of the central main leg.

11. A three-phase and three-leg core structure as claimed in claim 8, wherein oil ducts are formed in the yoke and extend in the longitudinal direction thereof, each of said oil ducts extending along the entire length of each segment of the yoke.

12. A three-phase and three-leg core structure as claimed in claim 1, wherein the steel plate laminations stacked in layers to constitute the central main leg are trapezoidal in form.

13. A three-phase and three-leg core structure as claimed in claim 8, wherein the steel plates stacked in layers to constitute the central main leg are in the form of a parallelogram.

14. A three-phase and three-leg core structure as claimed in claim 8, wherein the difference in length between the edges of the leg and yoke laminations forming the respective oblique miter joints is about 10% of the longer edge so that the magnetic flux distribution is substantially similar to that obtained when the edges are the same length.

15. The three-phase and three-leg core structure as claimed in claim 14, wherein cutouts are formed at the miter joints of the steel plates constituting at least the central main leg and the steel plates constituting the yoke in a manner such that said cutouts are formed in the steel plate laminations of the greater width determined by comparing the central main leg with the yoke.

16. The core structure of claim 1, wherein the yoke steel plates are magnetically connected to the steel plates of the outer main legs by oblique miter joints, and wherein in each of the respective layers of said core structure the joint angles provided at the oblique miter joints magnetically connecting the outer main legs to the yoke are the same angle, and wherein in adjacent layers of said core structure joint edges of the outer main leg steel plates and corresponding yoke steel plates are mutually shifted parallely by a predetermined distance from a state where the apexes of both of said joint edges are in alignment whereby the occurrence of iron loss is minimized at the joint portions.

17. A core structure in a core for a core-type transformer comprising first and second core sections formed of a plurality of stacked steel plate laminations, corresponding laminations in said first and second core sections being magnetically connected to form respective layers of said core structure, said first and second core sections having different cross-sectional shapes of substantially equal cross-sectional area, and wherein the layers of said core structure each include a steel plate lamination of the first core section which is magnetically connected to a steel plate lamination of said second core section by at least one oblique miter joint without requiring the cutting-off of terminal ends of said laminations, and where in at least some of the joint angles which the oblique miter joints make with respect to the longitudinal axis of the first core section while magnetically connecting the steel plate laminations of the first core section to the corresponding steel plate laminations of the second core section are different angles, those joint angles of the oblique miter joints less than 45° occurring only where the width of the second core section plate is larger than that of the corresponding first core section plate, and those joint angles of the oblique miter joints greater than 45° occurring only where the width of the second core section steel plate is smaller than that of the corresponding first core section steel plate.

* * * * *